US008911037B2

(12) United States Patent
Hightower

(10) Patent No.: US 8,911,037 B2
(45) Date of Patent: Dec. 16, 2014

(54) BRACKETS AND ASSOCIATED COMPONENTS FOR DRAWER AND TRAY SLIDES IN CABINETRY

(75) Inventor: Robert C. Hightower, High Point, NC (US)

(73) Assignee: Tenn-Tex Plastics, Inc., Colfax, NC (US)

( * ) Notice: Subject to any disclaimer, the term of this patent is extended or adjusted under 35 U.S.C. 154(b) by 0 days.

(21) Appl. No.: 12/967,410

(22) Filed: Dec. 14, 2010

(65) Prior Publication Data

US 2012/0145845 A1 Jun. 14, 2012

(51) Int. Cl.
*A47B 88/06* (2006.01)
*A47B 88/04* (2006.01)

(52) U.S. Cl.
CPC ..... *A47B 88/044* (2013.01)
USPC ..... 312/330.1; 248/298.1; 312/334.5; 16/94 R

(58) Field of Classification Search
USPC ..... 248/201, 298.1; 16/94 R, 96 R; 312/352, 312/330.1, 334.5, 334.32, 334.27
See application file for complete search history.

(56) References Cited

U.S. PATENT DOCUMENTS 4,244,546 A * 1/1981 Mertes et al. ..... 248/258
5,257,861 A * 11/1993 Domenig et al. ..... 312/334.5
5,349,723 A * 9/1994 Domenig ..... 16/94 R
5,359,752 A * 11/1994 Domenig ..... 16/94 R
5,906,035 A * 5/1999 Atkins ..... 29/401.1
6,494,550 B1 * 12/2002 Chen et al. ..... 312/334.5
D469,001 S * 1/2003 Branson, Jr. ..... D8/374
6,733,098 B1 * 5/2004 Branson ..... 312/352
6,757,937 B2 * 7/2004 Salice ..... 16/94 R
6,854,817 B1 2/2005 Simon
7,090,320 B2 * 8/2006 Chen et al. ..... 312/334.5
7,331,644 B2 * 2/2008 Lowe ..... 312/334.4
2002/0101143 A1 * 8/2002 Crooks et al. ..... 312/334.5
2003/0160552 A1 * 8/2003 Bacho et al. ..... 312/334.5
2005/0264146 A1 * 12/2005 Fitz ..... 312/334.5

OTHER PUBLICATIONS

U.S. Appl. No. 12/729,450, filed Mar. 23, 2010, Hightower.

* cited by examiner

*Primary Examiner* — Terrell McKinnon
*Assistant Examiner* — Daniel Breslin
(74) *Attorney, Agent, or Firm* — Myers Bigel Sibley & Sajovec, P.A.

(57) ABSTRACT

A bracket for attaching a drawer slide to a cabinet wall includes: a main panel having front and rear surfaces, upper and lower edges, and opposed side edges; an L-shaped upper flange mounted to front surface of the main panel; an L-shaped lower flange mounted to the front surface of the main panel substantially parallel to the upper flange; a recess in the main panel positioned between the upper flange and the lower flange; an access ramp extending between one of the side edges and the recess; and means for mounting the main panel to the cabinet wall so that the rear surface confronts the rear wall. The upper and lower flanges are configured to capture the upper and lower edges of a panel of a mating bracket that is attached to a drawer slide. The recess is configured to receive and capture a nub extending from the panel of the mating bracket, the recess being of sufficient length that the nub can translate horizontally within the recess, thereby enabling the horizontal position of the mating bracket to be adjusted relative to the main panel.

7 Claims, 13 Drawing Sheets

BRACKETS AND ASSOCIATED COMPONENTS FOR DRAWER AND TRAY SLIDES IN CABINETRY

FIELD OF THE INVENTION

The present invention is directed generally to furniture, and more particularly to cabinets with sliding drawers and trays.

BACKGROUND OF THE INVENTION

Many cabinets, particularly those found in kitchens, include drawers for storing various items. Often, drawers are mounted to the cabinet with elongate slide members that are fixed to the drawer. Each slide member slidably engages a second elongate slide member that is fixed to the walls of the cabinet (often one of the slide members includes a small wheel that facilitates sliding motion). Some of such cabinets include multiple drawers, which can be disposed in vertically stacked fashion, side-by-side fashion, or both.

One of the simplest versions of a drawer slide is the so-called "epoxy-coated" drawer slide, which includes a channel that receives a wheel attached to the slide member that is fixed to the drawer. Typically, epoxy-coated drawer slides are mounted with brackets that are received on one end of the slide and that are fixed (typically with screws) to the rear wall of the cabinet.

Another popular drawer slide style is a "ball-bearing" drawer slide, which, as the name suggests, utilizes drawer slides mounted to the sides of the drawer that include ball bearings to augment relative movement. Ball bearing drawer slides are typically mounted directly to the front and rear walls of the cabinet.

Some drawers have slides that are mounted on the underside of the drawer (so-called "undermounted" drawer slides). These drawer slides may be preferred in some environments because they are less exposed than side-mounted drawer slides (and therefore may be less exposed to damage) and may avoid taking up space on either side of the drawer. In some embodiments, undermounted slides may have mechanisms that cause the drawer to close automatically without slamming. An exemplary undermounted drawer slide is the TANDEM slide, available from Blum, Inc. (Lincolnton, N.C.); another is illustrated in U.S. Pat. No. 6,854,817 to Simon.

When a drawer slide is to be mounted to the front or rear wall, often the wall will include mounting holes for receiving screws or other fasteners inserted through a mounting bracket that connects to the slide. However, the tolerances of cabinets and drawer slides are typically insufficiently precise to consistently position the holes in the mounting bracket for easy mounting of the drawer slide. Also, some currently popular cabinets have drawers that are configured such that, when the drawer is closed, the front face of the drawer is substantially flush with the front face of the cabinet. In such instances, it is typically desirable that the drawer be mounted precisely to ensure the flush relationship of the drawer face and cabinet face. However, achieving a flush relationship may be difficult due to inconsistencies in the thickness of the drawer face, the length of the cabinet and drawer slides, and the thickness of the front wall of the cabinet. In view of the foregoing, it may be desirable to provide a mounting technique that addresses these difficulties. It may also be desirable to provide a mounting system that allows the mounting of different drawer slide types.

SUMMARY OF THE INVENTION

As a first aspect, embodiments of the invention are directed to a bracket for attaching a drawer slide to a cabinet wall. The mounting bracket comprises: a main panel having front and rear surfaces, upper and lower edges, and opposed side edges; an L-shaped upper flange mounted to front surface of the main panel; an L-shaped lower flange mounted to the front surface of the main panel substantially parallel to the upper flange; a recess in the main panel positioned between the upper flange and the lower flange; an access ramp extending between one of the side edges and the recess; and means for mounting the main panel to the cabinet wall so that the rear surface confronts the rear wall. The upper and lower flanges are configured to capture the upper and lower edges of a panel of a mating bracket that is attached to a drawer slide. The recess is configured to receive and capture a nub extending from the panel of the mating bracket, the recess being of sufficient length that the nub can translate horizontally within the recess, thereby enabling the horizontal position of the mating bracket to be adjusted relative to the main panel.

As a second aspect, embodiments of the present invention are directed to a bracket assembly for mounting a drawer slide in a cabinet. The assembly comprises (a) a mounting bracket and (b) a mating bracket. The mounting bracket comprises: a main panel having front and rear surfaces, upper and lower edges, and opposed side edges; an L-shaped upper flange mounted to front surface of the main panel; an L-shaped lower flange mounted to the front surface of the main panel substantially parallel to the upper flange; a recess in the main panel positioned between the upper flange and the lower flange; an access ramp extending between at least one of the side edges and the recess; and means for mounting the main panel to the cabinet wall so that the rear surface confronts the rear wall. The mating bracket comprises: a panel with upper and lower edges; a nub extending from one side of the panel; and means for interconnecting with a drawer slide. The upper edge of the mating bracket panel is captured by the upper flange, the lower edge of the mating bracket panel is captured by the lower flange, and the nub is received in the recess. The recess and nub are configured such that the nub is free to translate horizontally within the recess relative to the main panel, such that the position of the mating bracket relative to the mounting bracket can be adjusted horizontally.

As a third aspect, embodiments of the present invention are directed to a method of mounting a drawer slide to the wall of a cabinet. The method comprises the steps of: (a) providing a mounting bracket as described above; (b) selecting a mating bracket, the mating bracket including a panel with upper and lower edges and a nub extending from one side of the panel, the mating bracket further including means for interconnecting with a drawer slide; (c) mounting the mounting bracket onto a rear wall of a cabinet with the mounting means, wherein the mounting means interface with pre-formed holes in the cabinet; (d) positioning the mating bracket relative to the mounting bracket such that the upper edge of the mating bracket panel is captured by the upper flange, the lower edge of the mating bracket panel is captured by the lower flange, and the nub is positioned on the access ramp; (e) sliding the mating bracket relative to the mounting bracket until the nub is positioned within the recess; and (f) sliding the mating bracket relative to the mounting bracket such that the nub moves horizontally within the recess, such relative movement adjusting the position of the mating bracket relative to the mounting bracket.

DETAILED DESCRIPTION OF EMBODIMENTS OF THE INVENTION

Figure 1:
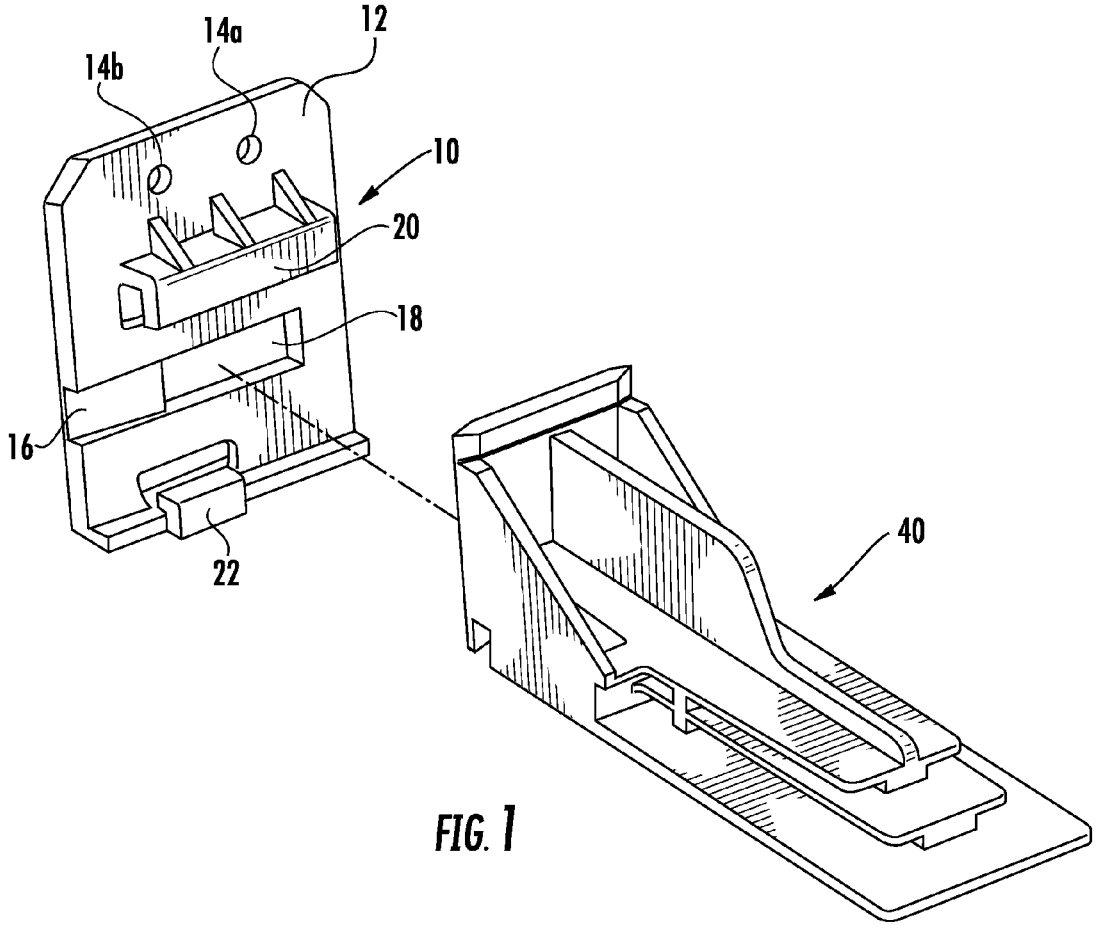
FIG. 1 is an exploded front perspective view of a bracket assembly according to embodiments of the present invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

Figure 2:
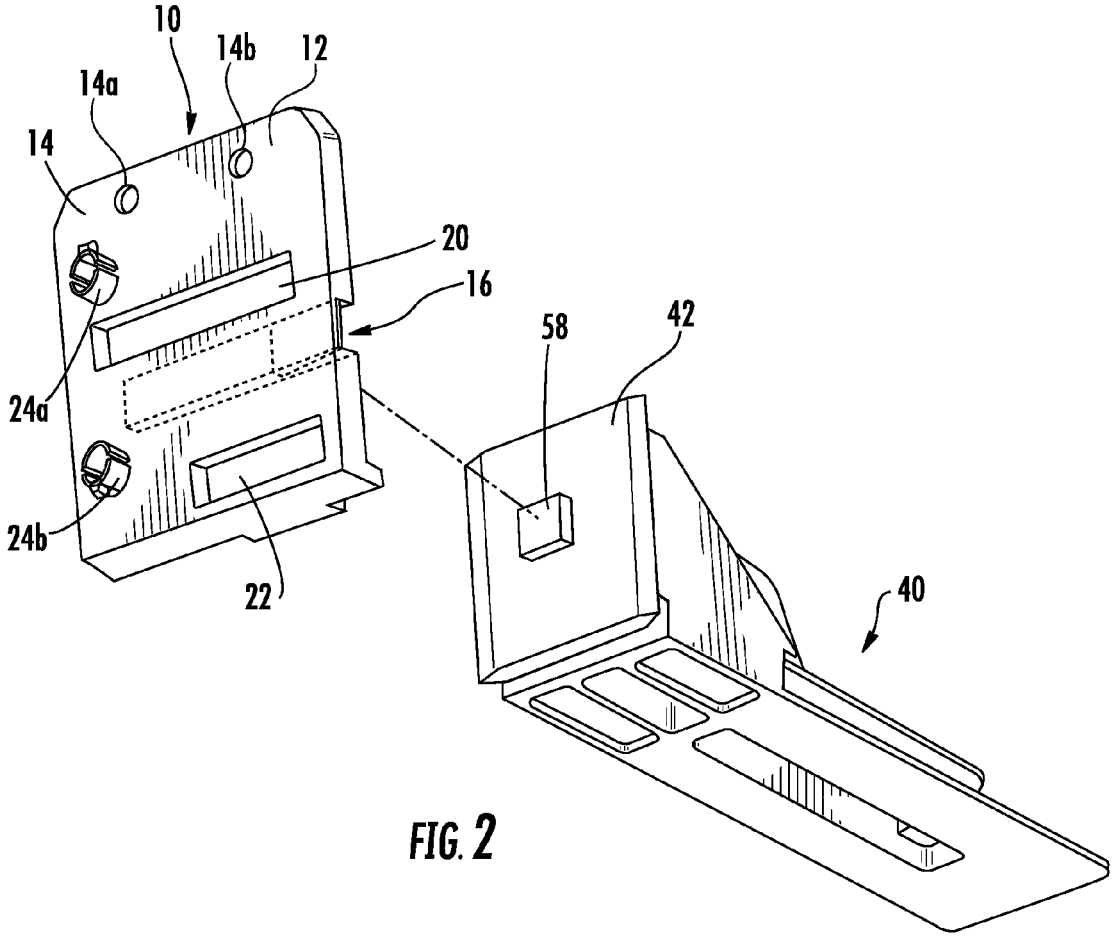
FIG. 2 is an exploded rear perspective view of the bracket assembly of FIG. 1.
Figure 3:
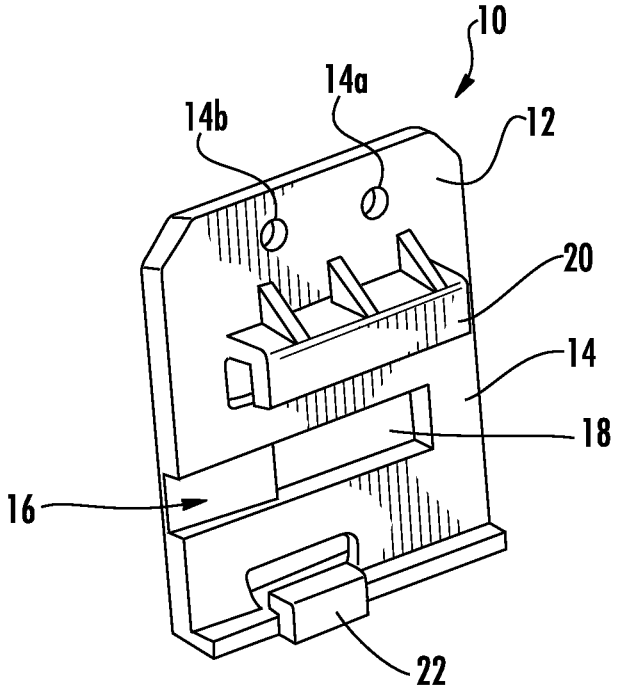
FIG. 3 is a front perspective view of the mounting bracket of the bracket assembly of FIG. 1.

Referring now to the figures, a mounting bracket, designated broadly at 10, is illustrated in FIGS. 1-3. The mounting bracket 10 includes a main panel 12 that has two apertures 14*a*, 14*b*. The apertures 14*a*, 14*b* are separated from each other by a distance equal to that of the conventionally preformed holes in the rear wall of a cabinet; typically this distance is between about 1 and 2 inches. An L-shaped upper flange 20 is located below the apertures 14*a*, 14*b* and projects from the front side of the main panel 12 and extends downwardly, and another L-shaped lower flange 22 projects from the front side of the main panel and extends upwardly.

An access ramp 16 leads from one edge of the main panel 12 toward the center of the main panel 12. The access ramp 16 leads to a rectangular recess 18 that extends horizontally between the upper and lower flanges 20, 22. The inwardmost portion of the access ramp 16 juts forwardly (i.e., toward the front surface of the main panel 12), with the result that the recess 18 is bounded on all sides: on three sides by the main panel 12, and on the fourth side by the inwardmost portion of the access ramp 16.

The back side of the main panel 12 includes two split dowels 24*a*, 24*b* in vertical alignment. The split dowels 24*a*, 24*b* are separated from each other by a distance equal to that of conventional dowel-accepting pre-formed holes in a cabinet. Typically this distance is between about 1 and 2 inches. Those of skill in this art will recognize that any number of known split dowel configurations may be suitable for use with the bracket 10.

The mounting bracket 10 is typically of unitary construction, but may be formed of multiple components if desired. The mounting bracket 10 may be formed of any material suitable for the mounting of drawer slides; a polymeric material, such as ABS, is typically employed.

Figure 4:
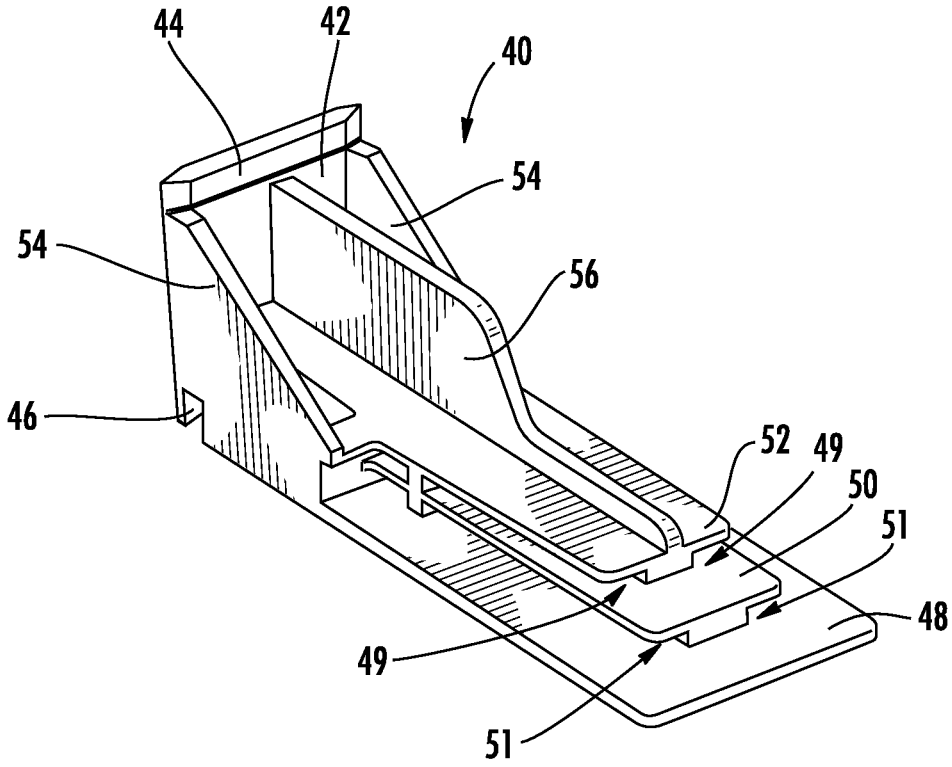
FIG. 4 is a front perspective view of the undermount slide bracket of the bracket assembly of FIG. 1.

Referring now to FIGS. 1, 3 and 4, an undermount slide bracket 40 is shown therein. The undermount slide bracket 40 has a vertical panel 42 with three sets of wings (lower wings 48, intermediate wings 50, and upper wings 52) that extend forwardly therefrom. The vertical panel 42 includes an upper edge 44 and a lower edge 46. The wings 48, 50, 52 are "stair stepped", such that the intermediate wings 50 extend forwardly slightly farther than do the upper wings 52, and the lower wings 48 extend forwardly slightly farther than do the intermediate wings 50. Gaps 49, 51 are formed between respective pairs of wings 48, 50, 52. Triangular gussets 54 extend between the panel 42 and the edges of the upper wings 52. A central rib 56 divides the wings 48, 50, 52 and extends upwardly from the upper wings 52. A rear nub 58 extends from the rear surface of the vertical panel 42 partially coextensive with a central portion of the rib 56 (see FIG. 1B). In some embodiments, vertically oriented stops are present between vertically adjacent wings (e.g., a stop may be present between 48 and 50).

The undermount slide bracket 40 is typically of unitary construction, but may be formed of multiple components if desired. The undermount slide bracket 40 may be formed of any material suitable for the mounting of drawer slides; a polymeric material, such as acetal, is typically employed.

Figure 5:
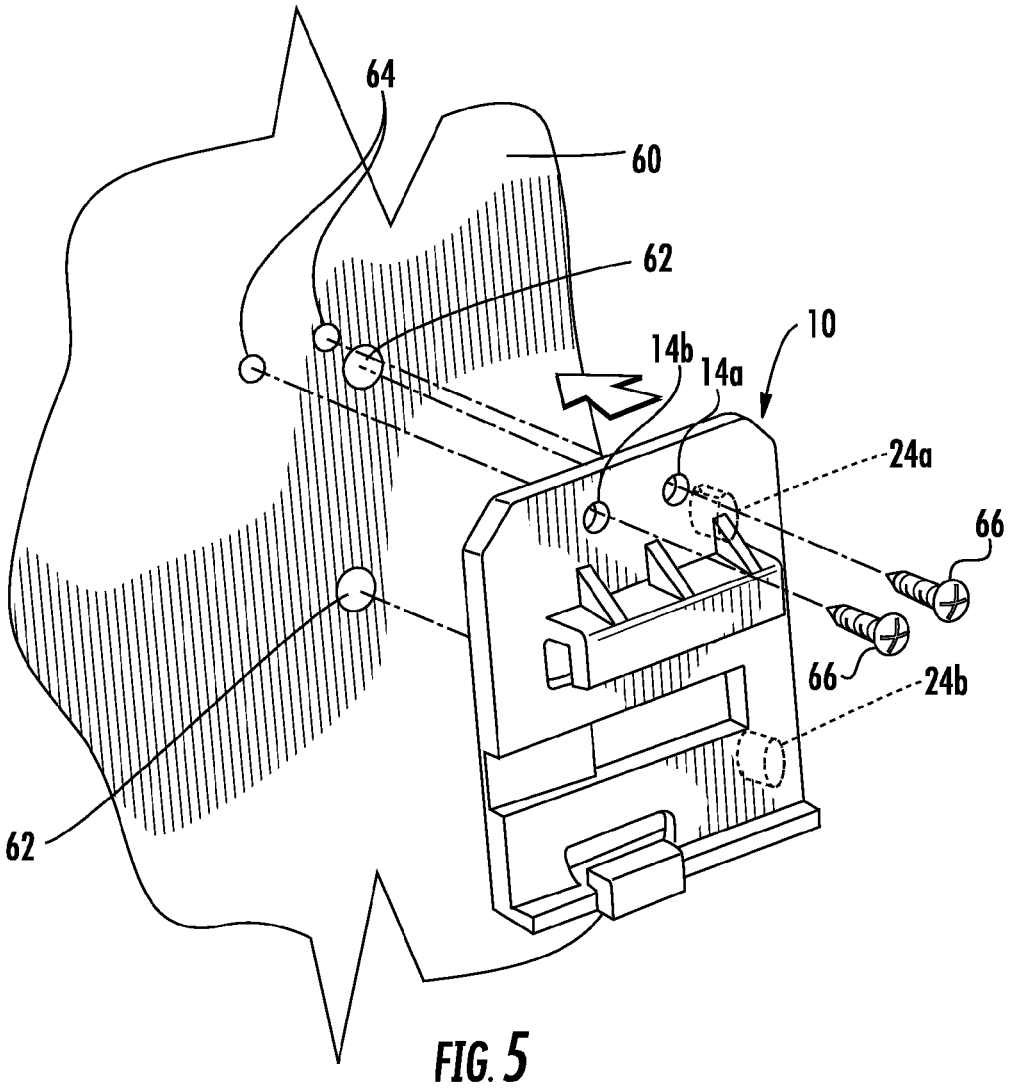
FIG. 5 is a front perspective view showing the mounting of the mounting bracket of FIG. 3 on the rear wall of a cabinet.
Figure 6:
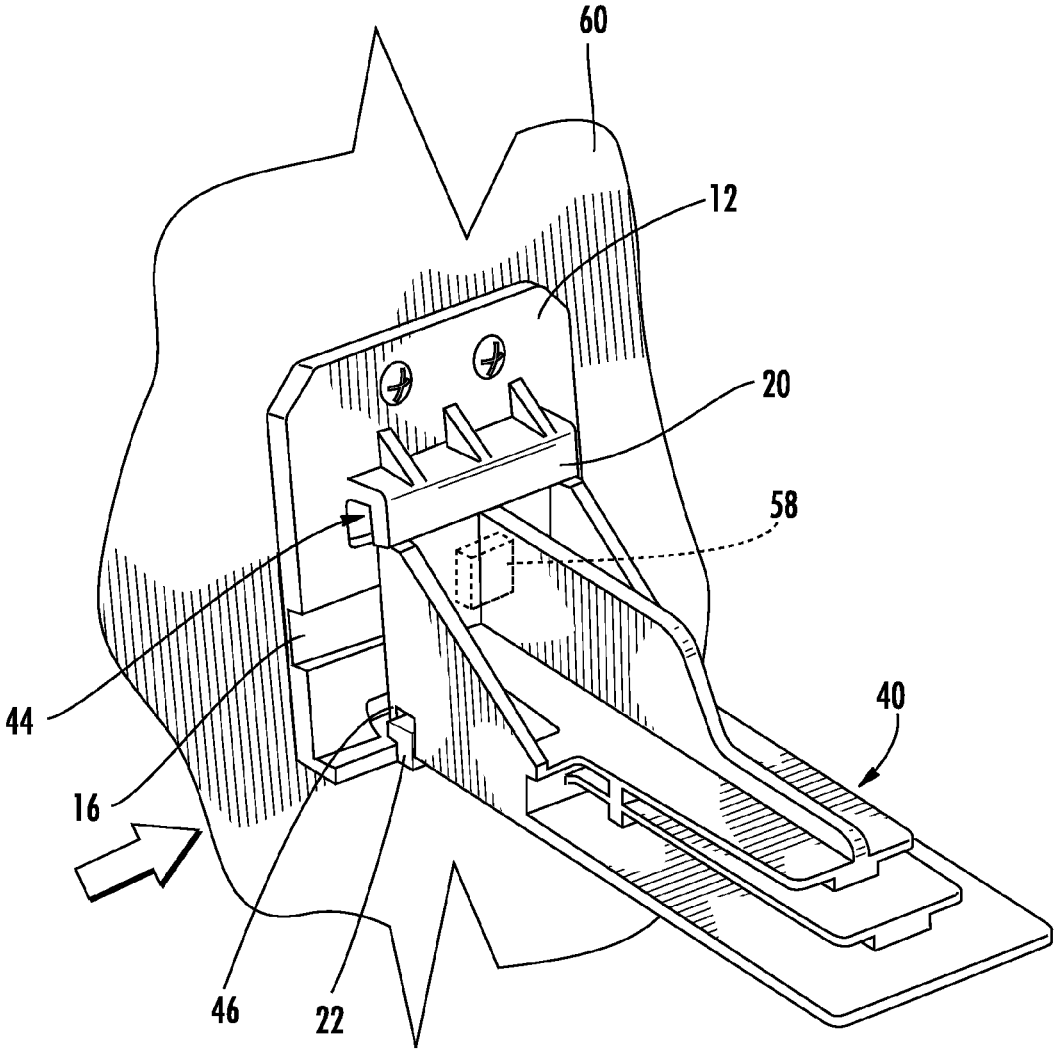
FIG. 6 is a front perspective view showing the mounting of the undermount slide bracket of FIG. 4 on the mounting bracket of FIG. 3.

Turning now to FIGS. 4-6, one possible use of the mounting bracket 10 and undermount slide bracket 40 is illustrated therein. A rear cabinet wall 60 includes two mounting holes 62. As used herein, the term "pre-formed hole" refers to a hole, bore, aperture or the like that is formed during the manufacture of the cabinet, rather than being drilled or bored by an installer of the drawer slide on-site. The mounting holes 62 receive the split dowels 24*a*, 24*b* of the mounting bracket 10 (FIG. 4). Once the mounting bracket 10 is fixed to the rear cabinet wall 60, the undermount slide bracket 40 is mounted onto the mounting bracket 12 in the manner described below.

Alternatively, the mounting bracket 10 may be mounted to the rear cabinet wall 60 via screws 66 inserted into the apertures 14*a*, 14*b*. The screws 66 are then inserted into preformed holes in the rear cabinet wall 60. Thus, it can be seen that, whether the cabinet has pre-formed holes for split dowels, screws, or both, the same mounting bracket 10 may be employed irrespective of which means for mounting the bracket 10 to the wall 62 is employed. This provides the installer with significant flexibility in mounting the mounting bracket 10 and, subsequently, the drawer slides.

Figure 7:
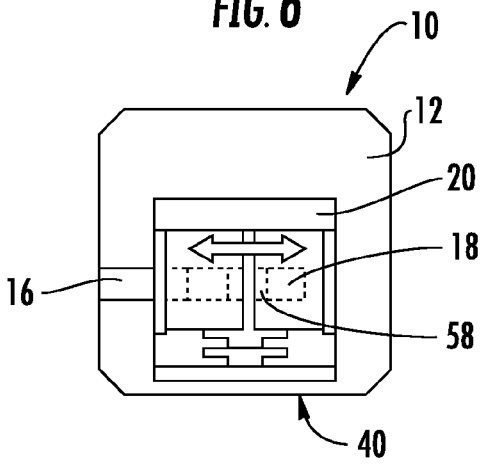
FIG. 7 is a front view of the undermount slide bracket mounted in the mounting bracket as illustrated in FIG. 6 showing how the undermount slide bracket can slide horizontally relative to the mounting bracket.

Interconnection of the mounting bracket 10 and the undermount slide bracket 40 is accomplished by sliding the upper edge 44 of the vertical panel 42 into the pocket created by the upper flange 20, and by sliding the lower edge 46 of the vertical panel 42 into the pocket created by the lower flange 22 (FIG. 6). When so positioned, the rear nub 58 is received in the access ramp 16 in the main panel 12. The undermount slide bracket 40 is then slid toward the center of the mounting bracket 10 until the rear nub 58 is received in and captured by the recess 18. Once the nub 58 is positioned within the recess 18, the bracket 40 is free to slide horizontally relative to the main panel 12 until the nub 58 strikes either of the side edges of the recess 30 (FIG. 7). Thus, the position of the undermount slide bracket 40 relative to the mounting bracket 12 can be adjusted.

Figure 8:
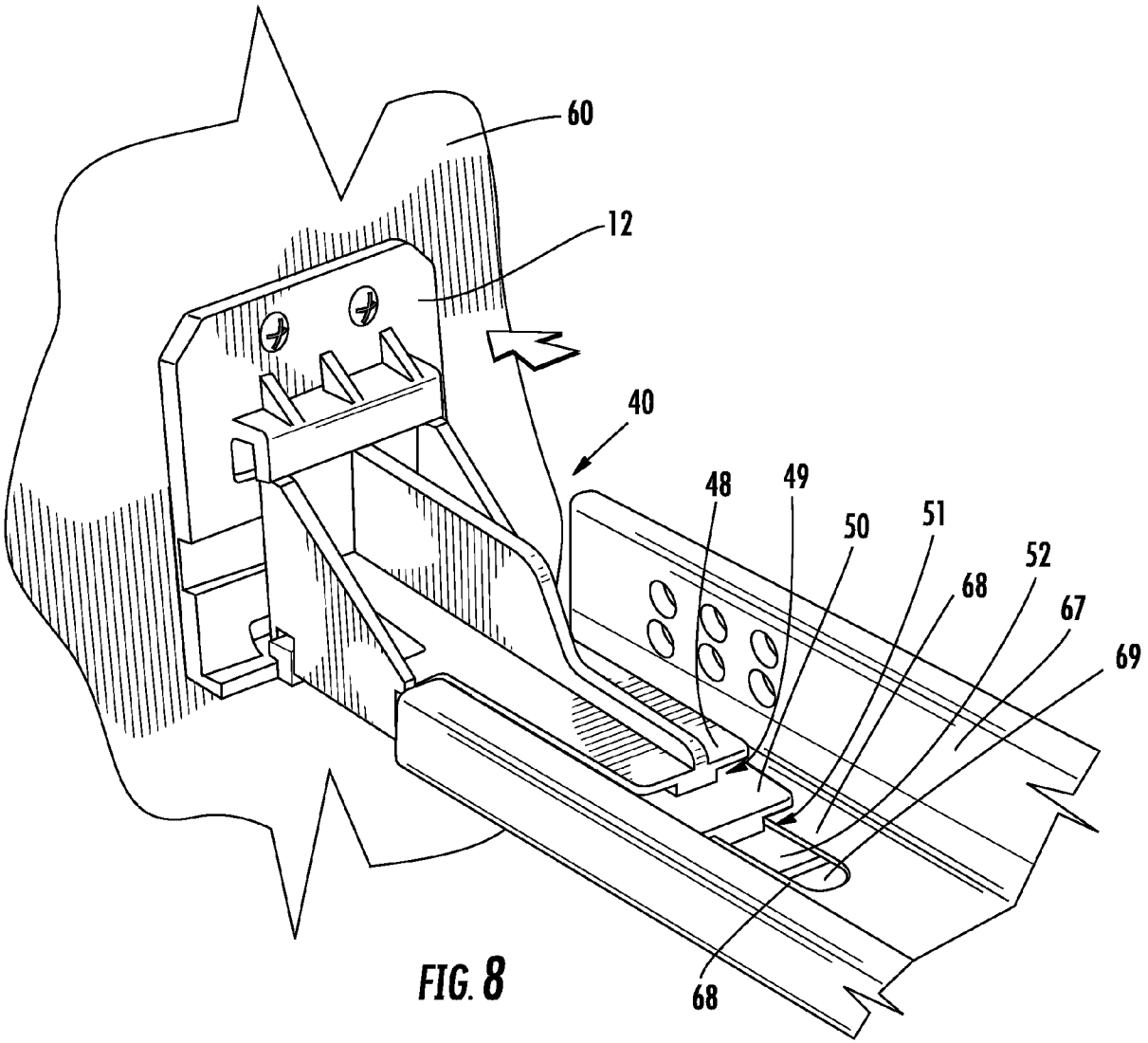
FIG. 8 is a front perspective view showing the mounting of the undermount slide bracket of FIG. 4 on a drawer slide.

Once the mounting bracket 10 and undermount slide bracket 40 have been mounted to the cabinet wall 60 (typically by the manufacturer), a drawer slide 67 can be mounted to the undermount slide bracket 40. Typically, the drawer slide 67 will not already be attached to the underside of a drawer, although this need not be the case. Mounting is achieved by sliding lips 68 that define a slot 69 in the drawer slides 67 into a set of the gaps 49, 51 between wings 48, 50, 52 of the undermount slide bracket 40 (FIG. 8) (in the illustrated embodiment, the lips 68 are positioned in the gap 51 between wings 50 and 52). If stops are present between vertically adjacent wings, they can ensure that the slides 67 of the same drawer are positioned similarly within the undermount slide bracket 40. Notably, because the undermount slide bracket 40 is free to slide horizontally relative to the mounting bracket 10, the horizontal position of the undermount slide bracket 40 can be adjusted so that the drawer slide 67 can be received more readily and easily even though the drawer slide 67 is already mounted to the drawer.

It should be noted that the dimensions of the upper and lower edges 44, 46 of the undermount slide bracket 40, the upper and lower flanges 20, 22, and/or the nub 58 may be selected so that there is some frictional resistance to horizontal movement of the nub 58 within the recess 18. Such frictional resistance can limit unwanted horizontal movement, such that once the position of the undermount slide bracket 40 has been adjusted, the undermount slide bracket 40 remains in place and provides stable mounting to the drawer slide 67.

It should also be noted that, although the undermount slide bracket 40 is illustrated herein, other varieties of undermount slide brackets that are suitable for mounting of undermount drawer slides may also be employed. For example, brackets available from Tenn-Tex, Inc. (Colfax, N.C.) having Model Nos. C-107, C-174, and C-182-00 offer structures other than the wings 48, 50, 52 for mating with different types of undermount drawer slides; any of these structures may be combined with the structure of the panel 42 and nub 58 to enable the resulting combination to mount an undermount drawer slide onto the mounting bracket 10. Other exemplary undermount slide bracket structures include those that can mate with the SOLO drawer runner, available from Blum, Inc., and the EXPRESS drawer slide, available from Grass America, Inc. (Kernersville, N.C.).

Figure 9:
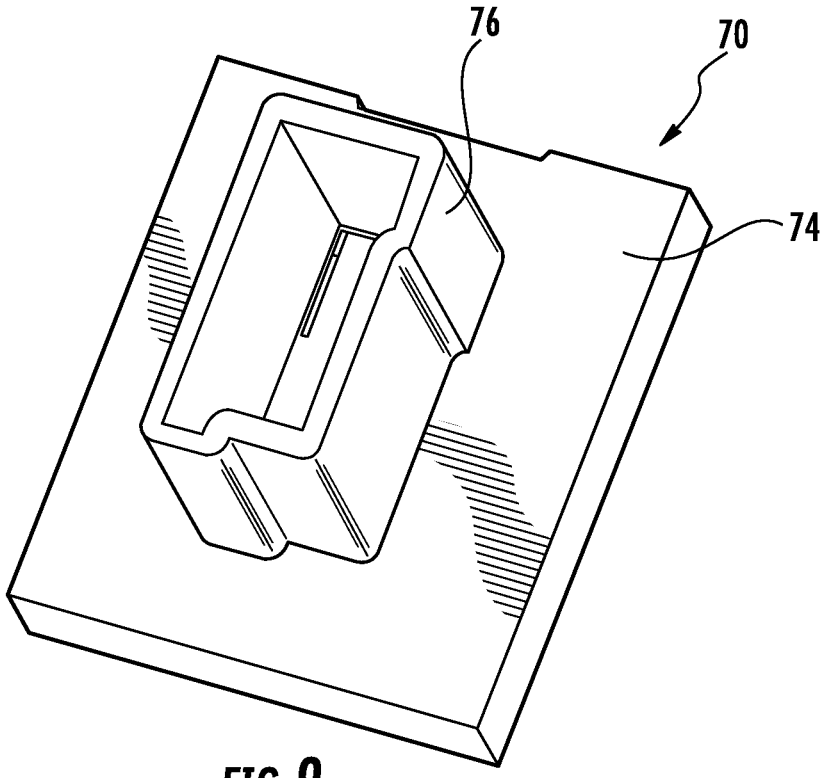
FIG. 9 is a front perspective view of a bracket for an epoxy-coated drawer slide according to alternative embodiments of the invention.
Figure 10:
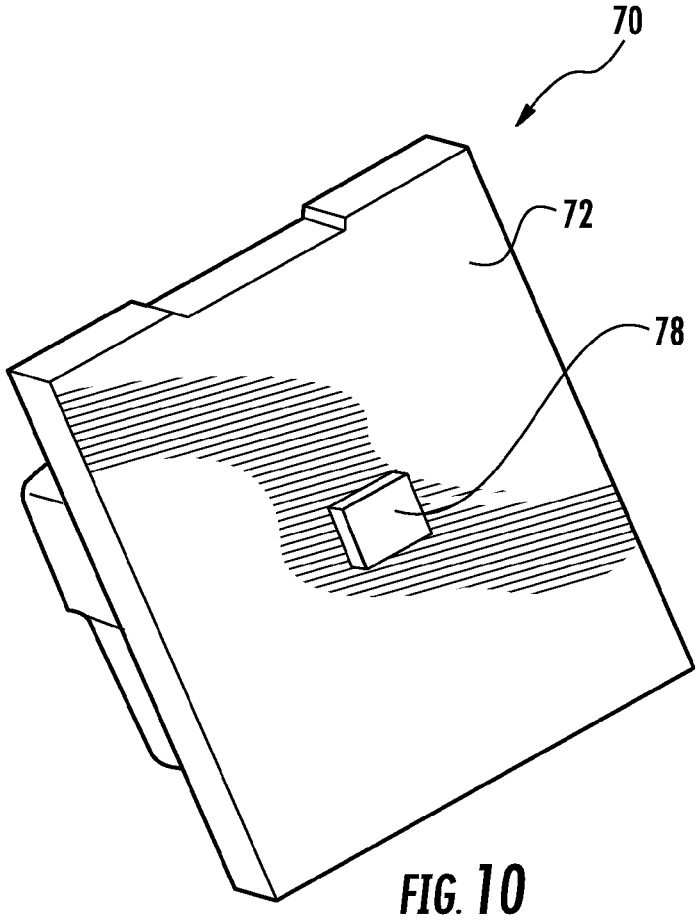
FIG. 10 is a rear perspective view of the bracket of FIG. 9.
Figure 11:
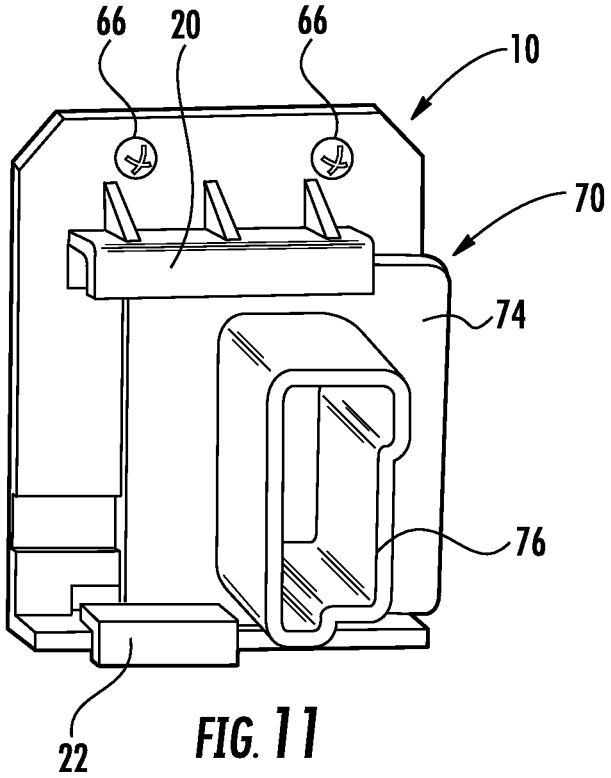
FIG. 11 is a front perspective view of the bracket of FIGS. 9 and 10 mated with the mounting bracket of FIG. 3.

Turning now to FIGS. 9-11, another bracket 70, in this instance suitable for mounting an epoxy slide, is shown therein. The epoxy slide mounting bracket 70 includes a panel 74 with a capture pocket 76 configured to receive the end of an epoxy slide. A rear nub 78 projects from the rear side of the panel 74.

As was the case with the undermount slide bracket 40, the epoxy slide mounting bracket 70 can be interconnected with the mounting bracket 10 and its position relative to the mounting bracket 10 may be adjusted as the nub 78 slides within the recess 18 of the mounting bracket 10 (see FIG. 11). An epoxy slide can then be inserted into the capture pocket 76 of the epoxy slide mounting bracket 70. Once again, the mounting bracket 10 can be mounted to the rear wall 60 of a cabinet via either preformed holes for the split dowels 24*a*, 24*b* and/or via screws inserted through the apertures 14*a*, 14*b* into preformed screw holes in the cabinet wall 60.

In the manner described above in connection with the undermount slide bracket 40, the capture pocket 76 may be replaced with another structure suitable for mounting with epoxy drawer slides. For example, brackets available from Tenn-Tex, Inc, supra, having Model Nos. C-069, C-089, C-105 and C-151-01 offer different structures for mounting to different varieties of epoxy-coated drawer slides; these may be combined with the panel 74 and nub 78 for mounting of these differently configured epoxy-coated drawer slides.

Figure 12:
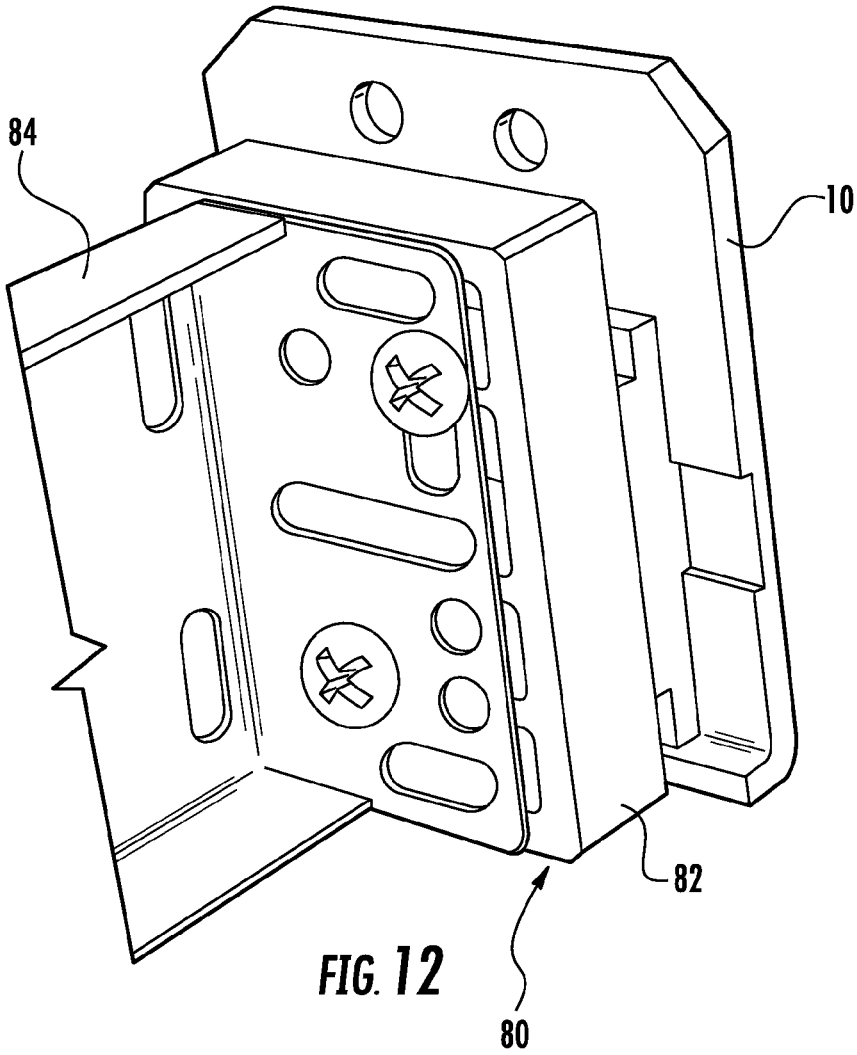
FIG. 12 is a front perspective view of a ball-bearing bracket mounted to a ball-bearing drawer slide and mated with the bracket of FIG. 3.

Referring now to FIG. 12, a third bracket 80, in this instance suitable for mounting a ball-bearing slide, is shown therein. The ball bearing bracket 80 includes a body 82 with screw holes for receiving screws and upper and lower edges that can fit within the upper and lower flanges 20, 22, and on its rear side the ball bearing bracket 80 includes a rear nub that is received in the recess 18 of the mounting bracket 10 in the same manner as described above with respect to the undermount slide bracket 40 and the epoxy slide bracket 70. Thus, in the manner discussed above, the ball bearing bracket 80 can be interconnected with the mounting bracket 10 and its position relative to the mounting bracket 10 adjusted as needed. The ball bearing slide 84 can then be attached via screws to the ball bearing bracket 80 either before or after the ball-bearing bracket 80 is mounted on the mounting bracket 10. Once again, the mounting bracket 10 can be mounted via either the split dowels 24*a*, 24*b*, screws inserted into the apertures 14*a*, 14*b*, or both. Also, other structures for mounting ball bearing drawer slides may be included in lieu of the body 82.

The foregoing demonstrates that the mounting bracket 10 can be employed with any of undermount drawer slides, epoxy drawer slides and ball bearing drawer slides in conjunction with a mating bracket that includes (a) a main panel with upper and lower edges that can fit within the upper and lower flanges 20, 22 (b) a nub that is received within the recess 18, and (c) structure for mounting the type of drawer slide of interest. This bracket assembly provides the manufacturer with significant flexibility and convenience, as he needs to carry and utilize only one type of mounting bracket (rather than all three types) to mount any of the drawer slide configurations within the same variety of cabinet, can accomplish that mounting with common mounting holes 62 for the mounting bracket 10, and can still provide the cabinet with the desirable adjustability that facilitates installation. Moreover, changing from one drawer slide type to another, should the consumer decide to do so, can also be accomplished easily and with the same mounting bracket.

Figure 13:
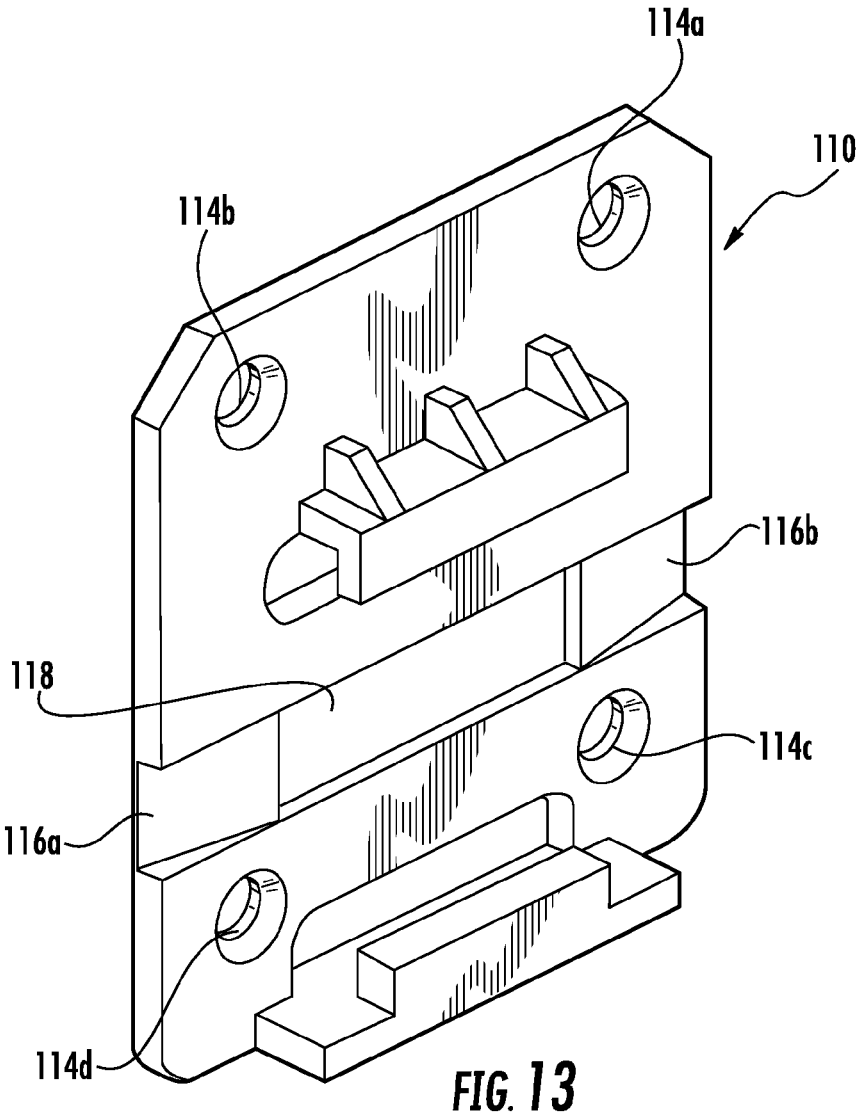
FIG. 13 is a front perspective view of a mounting bracket according to additional embodiments of the present invention.

Referring now to FIG. 13, another mounting bracket, designated broadly at 110, is illustrated therein. The mounting bracket 110 is similar to the mounting bracket 10 with the exceptions that (a) the split dowels are omitted, (b) there are four mounting apertures 114*a*, 114*b*, 114*c*, 114*d* that are spaced in the corners of the main panel 112, and (c) there are two access ramps 116*a*, 116*b* (rather than just one) that lead to the recess 118. This mounting bracket 110 is mounted to a cabinet wall with screws inserted through the apertures 114*a*-114*d* and into preformed holes in the cabinet wall. The mounting bracket 110 can be interconnected to any of the drawer slide bracket types discussed above.

Notably, the mounting bracket 110 provides the additional advantage that it is symmetrical, and can therefore be used on either side (i.e., left or right) of a cabinet. As a result, the manufacturer has even greater flexibility with the mounting bracket 110, as he can carry only one variety of mounting bracket for each cabinet and use it on either side of the cabinet, yet still can mount any of the drawer slide types mentioned above.

Figure 14:
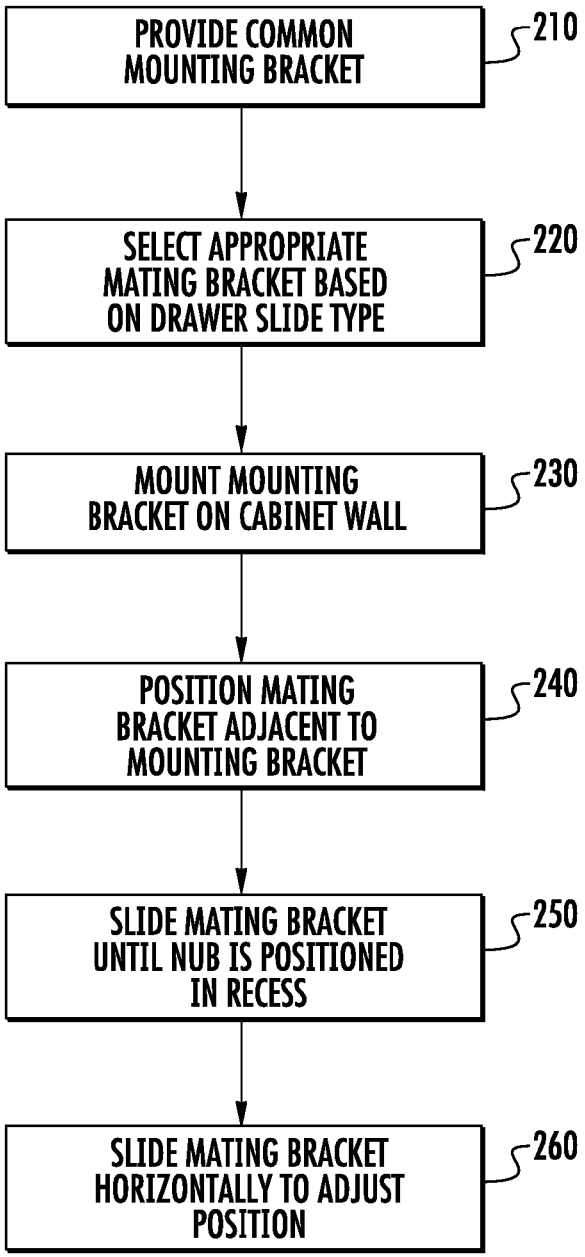
FIG. 14 is a flow chart illustrating methods of mounting drawer slides according to embodiments of the present invention.

Referring now to FIG. 14, a method according to embodiments of the invention is illustrated. The method comprises the steps of: (a) providing a mounting bracket of the type described above (Block 210); (b) selecting a mating bracket including a panel with upper and lower edges, a nub extending from one side of the panel, and means for interconnecting with a drawer slide (Block 220); (c) mounting the mounting bracket onto a rear wall of a cabinet with the mounting means, wherein the mounting means interface with pre-formed holes in the cabinet (Block 230); (d) positioning the mating bracket relative to the mounting bracket such that the upper edge of the mating bracket panel is captured by the upper flange, the lower edge of the mating bracket panel is captured by the lower flange, and the nub is positioned on the access ramp (Block 240); (e) sliding the mating bracket relative to the mounting bracket until the nub is positioned within the recess (Block 250); and (f) sliding the mating bracket relative to the mounting bracket such that the nub moves horizontally within the recess, such relative movement adjusting the position of the mating bracket relative to the mounting bracket (Block 260). In some instances, the drawer slide is mounted on the mating bracket prior to step (d) above.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A bracket for attaching a drawer slide to a cabinet wall, comprising:

a main panel having front and rear surfaces, upper and lower edges, and opposed side edges;

an L-shaped upper flange mounted to front surface of the main panel;

an L-shaped lower flange mounted to the front surface of the main panel substantially parallel to the upper flange;

a recess in the main panel positioned between the upper flange and the lower flange;

an access ramp recessed and contiguous with the main panel and extending between one of the side edges and the recess; and means for mounting the main panel to the cabinet wall so that the rear surface confronts the rear wall, wherein the means for mounting the main panel to the cabinet wall comprises screws inserted through apertures in the main panel that are received in pre-formed holes in the cabinet wall;

wherein the upper and lower flanges are configured to capture the upper and lower edges of a panel of a mating bracket that is attached to a drawer slide, and wherein the recess is configured to receive and capture a nub extending from the panel of the mating bracket, the recess being of sufficient length that the nub is free to translate horizontally within the recess, thereby enabling the horizontal position of the mating bracket to be adjusted relative to the main panel.

2. The bracket defined in claim 1, wherein the means for mounting the main panel to the cabinet wall comprises a plurality of split dowels mounted to the rear surface that are configured to be received in pre-formed holes in the cabinet wall.

3. A bracket assembly for mounting a drawer slide in a cabinet, comprising:

(a) a mounting bracket comprising:

a main panel having front and rear surfaces, upper and lower edges, and opposed side edges;

an L-shaped upper flange mounted to front surface of the main panel;

an L-shaped lower flange mounted to the front surface of the main panel substantially parallel to the upper flange;

a recess in the main panel positioned between the upper flange and the lower flange;

an access ramp recessed and contiguous with the main panel and extending between at least one of the side edges and the recess; and means for mounting the main panel to the cabinet wall so that the rear surface confronts the rear wall, wherein the means for mounting the main panel to the cabinet wall comprises screws inserted through apertures in the main panel that are received in pre-formed holes in the cabinet wall; and (b) a mating bracket comprising:

a panel with upper and lower edges;

a nub extending from one side of the panel; and means for interconnecting with a drawer slide;

wherein the upper edge of the mating bracket panel is captured by the upper flange, the lower edge of the mating bracket panel is captured by the lower flange, and the nub is received in the recess;

wherein the recess and nub are configured such that the nub is free to translate horizontally within the recess relative to the main panel, such that the position of the mating bracket relative to the mounting bracket can be adjusted horizontally.

4. The bracket assembly defined in claim 3, wherein the means for mounting the main panel to the cabinet wall comprises a plurality of split dowels mounted to the rear surface that are configured to be received in pre-formed holes in the cabinet wall.

5. The bracket assembly defined in claim 3, wherein the means for interconnecting with a drawer slide is configured to interconnect with one of: an undermount drawer slide; a ball bearing drawer slide; or an epoxy coated drawer slide.

6. A bracket for attaching a drawer slide to a cabinet wall, comprising:

a main panel having front and rear surfaces, upper and lower edges, and opposed side edges;

an L-shaped upper flange mounted to front surface of the main panel;

an L-shaped lower flange mounted to the front surface of the main panel substantially parallel to the upper flange;

a recess in the main panel positioned between the upper flange and the lower flange;

an access ramp recessed and contiguous with the main panel and extending between one of the side edges and the recess; and means for mounting the main panel to the cabinet wall so that the rear surface confronts the rear wall, wherein the means for mounting the main panel to the cabinet wall comprises both a plurality of split dowels mounted to the rear surface that are configured to be received in pre-formed holes in the cabinet wall and screws inserted through apertures in the main panel that are received in pre-formed holes in the cabinet wall;

wherein the upper and lower flanges are configured to capture the upper and lower edges of a panel of a mating bracket that is attached to a drawer slide, and wherein the recess is configured to receive and capture a nub extending from the panel of the mating bracket, the recess being of sufficient length that the nub is free to translate horizontally within the recess, thereby enabling the horizontal position of the mating bracket to be adjusted relative to the main panel.

7. A bracket assembly for mounting a drawer slide in a cabinet, comprising:

(a) a mounting bracket comprising:

a main panel having front and rear surfaces, upper and lower edges, and opposed side edges;

an L-shaped upper flange mounted to front surface of the main panel;

an L-shaped lower flange mounted to the front surface of the main panel substantially parallel to the upper flange;

a recess in the main panel positioned between the upper flange and the lower flange;

an access ramp recessed and contiguous with the main panel and extending between at least one of the side edges and the recess; and means for mounting the main panel to the cabinet wall so that the rear surface confronts the rear wall, wherein the means for mounting the main panel to the cabinet wall comprises both a plurality of split dowels mounted to the rear surface that are configured to be received in pre-formed holes in the cabinet wall and screws inserted through apertures in the main panel that are received in pre-formed holes in the cabinet wall; and (b) a mating bracket comprising:

a panel with upper and lower edges;

a nub extending from one side of the panel; and means for interconnecting with a drawer slide;

wherein the upper edge of the mating bracket panel is captured by the upper flange, the lower edge of the mating bracket panel is captured by the lower flange, and the nub is received in the recess;

wherein the recess and nub are configured such that the nub is free to translate horizontally within the recess relative to the main panel, such that the position of the mating bracket relative to the mounting bracket can be adjusted horizontally.

* * * * *